US010971856B1

(12) United States Patent
Reynoso Galvan et al.

(10) Patent No.: US 10,971,856 B1
(45) Date of Patent: Apr. 6, 2021

(54) LEVER-TYPE ELECTRICAL CONNECTOR

(71) Applicant: Aptiv Technologies Limited, St. Michael (BB)

(72) Inventors: Naiki Alenjandra Reynoso Galvan, Rochester Hills, MI (US); Erick A. Rodriguez, Juarez (MX); Katy Stephanie Almonte Cortes, Rochester Hills, MI (US); Rodrigo Villanueva Ponce, Royal Oak, MI (US)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 16/776,857

(22) Filed: Jan. 30, 2020

(51) Int. Cl.
*H01R 13/62* (2006.01)
*H01R 13/629* (2006.01)
*H01R 13/502* (2006.01)

(52) U.S. Cl.
CPC ..... *H01R 13/62938* (2013.01); *H01R 13/502* (2013.01); *H01R 2201/26* (2013.01)

(58) Field of Classification Search
CPC .. H01L 3/62938; H01L 13/502; H01L 201/76
USPC ..... 439/472
See application file for complete search history.

(56) References Cited

U.S. PATENT DOCUMENTS 5,252,084 A * 10/1993 Wakata ..... H01R 13/62955 439/157
5,401,179 A * 3/1995 Shinchi ..... H01R 13/62933 439/157
5,938,458 A * 8/1999 Krehbiel ..... H01R 13/62938 439/157
6,139,351 A 10/2000 Schaefer et al.
6,217,354 B1 * 4/2001 Fencl ..... H01R 13/62977 439/157
6,319,050 B1 * 11/2001 Miyazaki ..... H01R 13/62938 439/157
6,325,647 B1 12/2001 May et al.
6,413,105 B2 * 7/2002 Noro ..... H01R 13/62938 439/157
6,551,118 B2 * 4/2003 Langolf ..... H01R 13/6295 439/157
6,565,372 B2 5/2003 Bakker et al.
6,739,889 B1 5/2004 Daggett et al.
6,811,416 B2 * 11/2004 Yano ..... H01R 9/2625 439/152

(Continued)

FOREIGN PATENT DOCUMENTS

CN 207819009 9/2018
CN 207819009 U 9/2018

(Continued)

*Primary Examiner* — Alexander Gilman
(74) *Attorney, Agent, or Firm* — Colby Nipper PLLC

(57) ABSTRACT

A lever-type electrical connector (102), a corresponding mating electrical connector (104) for accepting the lever-type electrical connector (102), and a lever-type electrical connector assembly (100) thereof are described herein. The lever-type electrical connector (102) has a first portion (300) with a first slot (302) configured to accept a rib protrusion (114) of the corresponding mating electrical connector (104) and a lever (304) pivotally mounted to the first portion (300) with cam grooves (408) on opposing interior surfaces configured to accept cam-follower protrusions (210) on opposite sides of the rib protrusion (114).

20 Claims, 5 Drawing Sheets

(56) References Cited

U.S. PATENT DOCUMENTS 6,846,191 B2 * 1/2005 Hobbs ..... H01R 13/4538 439/140
6,997,725 B2 * 2/2006 Stella ..... H01R 13/453 439/157
7,094,081 B1 8/2006 Senk et al.
7,241,156 B1 * 7/2007 Margrave ..... H01R 13/62938 439/157
7,267,564 B2 * 9/2007 Bauman ..... H01R 13/62955 439/157
7,513,783 B2 * 4/2009 Okuda ..... H01R 13/62955 439/157
8,075,351 B2 12/2011 Park et al.
8,784,127 B2 * 7/2014 Bashkin ..... H01R 13/62944 439/372
9,178,307 B2 * 11/2015 Papurcu ..... H01R 13/533
9,291,184 B2 3/2016 Zabielski et al.
9,608,357 B1 * 3/2017 Sundarakrishnamachari ..... H01R 13/4534
9,653,845 B2 5/2017 Ludwig et al.
9,692,153 B1 * 6/2017 Rodriguez ..... H01R 13/62938
9,728,896 B2 8/2017 Papurcu et al.
10,177,493 B2 * 1/2019 Yildiz ..... H01R 13/62927
10,256,555 B2 4/2019 Loew et al.
2002/0182908 A1 * 12/2002 Maegawa ..... H01R 13/4538 439/157
2014/0273566 A1 * 9/2014 Allgood ..... H01R 13/62944 439/157
2016/0099520 A1 * 4/2016 Papurcu ..... H01R 13/62955 439/752

FOREIGN PATENT DOCUMENTS

CN 208461115 U 2/2019
WO 2019129149 A1 7/2019

* cited by examiner

LEVER-TYPE ELECTRICAL CONNECTOR

BACKGROUND

Lever-type electrical connectors are often used in high-speed, high-reliability, and high insertion force applications, e.g., in a vehicle wiring harness for connecting to an electrical-center. Conventional lever-type connectors use U-shaped levers that surround the exterior of the connector. The levers generally have cam grooves on external faces for engaging cam-follower protrusions on opposing interior faces of corresponding mating electrical connectors. High insertion forces often cause bending of supports of the cam-follower protrusions, which leads to the cam-follower protrusions either disengaging the cam grooves or breaking off the supports. Thickening and strengthening the supports to withstand these high insertion forces ultimately increases the cost, weight, and footprint of the corresponding mating electrical connector and/or connector, thereby reducing available space or budget for other electrical connections and circuits within a vehicle system.

SUMMARY

A lever-type electrical connector assembly is described including a corresponding mating electrical connector for accepting a lever-type electrical connector, which are configured to prevent structural bending that occurs in other lever-type electrical connector assemblies when undergoing high insertion forces. Although the embodiments below are described in terms of connections to a corresponding mating electrical connector of an electrical-center, the lever-type connector, corresponding mating electrical connector, and assemblies thereof may be easily adapted to other applications, e.g., wire-to-wire connections, fiber-optic connections, harness-to-harness connections, and electrical-center-to-electrical-center connections.

In some aspects, a lever-type electrical connector has a first portion with a first slot configured to accept a rib protrusion of a corresponding mating electrical connector, a second portion affixed to the first portion with a second slot centered with the first slot, and a lever pivotally mounted to the first portion with cam grooves on opposing interior surfaces configured to accept cam-follower protrusions on opposite sides of the rib protrusion.

In some aspects, the corresponding mating electrical connector has the rib protrusion with the cam-follower protrusions along with a plurality of cavities for accepting electrical terminals that are disposed on each side of the rib protrusion. The cam-follower protrusions extend from outward-facing sides of the rib protrusion for acceptance by the cam grooves in the lever of the lever-type electrical connector.

This summary is provided to introduce simplified concepts for an example lever-type electrical connector assembly, which is further described below in the Detailed Description and Drawings. For ease of description, the disclosure focuses on automotive systems; however, the techniques are not limited to automobiles but apply to electrical connectors of other types of vehicles and systems. This summary is not intended to identify essential features of the claimed subject matter, nor is it intended for use in determining the scope of the claimed subject matter.

BRIEF DESCRIPTION OF THE DRAWINGS

A lever-type electrical connector, a corresponding mating electrical connector for accepting the lever-type electrical connector, and an assembly thereof are described with reference to the following drawings. The same numbers are used throughout the drawings to reference like features and components.

DETAILED DESCRIPTION

Overview

Lever-type electrical connectors may enable multiple electrical connections from within a single connector. A lever with cam grooves on the lever-type electrical connector engages cam-follower protrusions in a corresponding mating electrical connector. Often, because of high insertion forces, the cam-follower protrusions either pop out of the cam grooves or the cam-follower protrusions break off the corresponding mating electrical connector, causing insecure or incomplete connections. To mitigate structural bending, traditional lever-type electrical connectors have relied on material reinforcement of the corresponding mating electrical connectors at portions that support the cam-follower protrusions. Material reinforcement in this way can increase the cost, weight, and size of the connector assembly.

Lever-type electrical connector assemblies are described herein that are configured to prevent structural bending resulting from high insertion forces, without necessitating reinforced corresponding mating electrical connectors.

Lever-Type Electrical Connector Assembly

Figure 1:
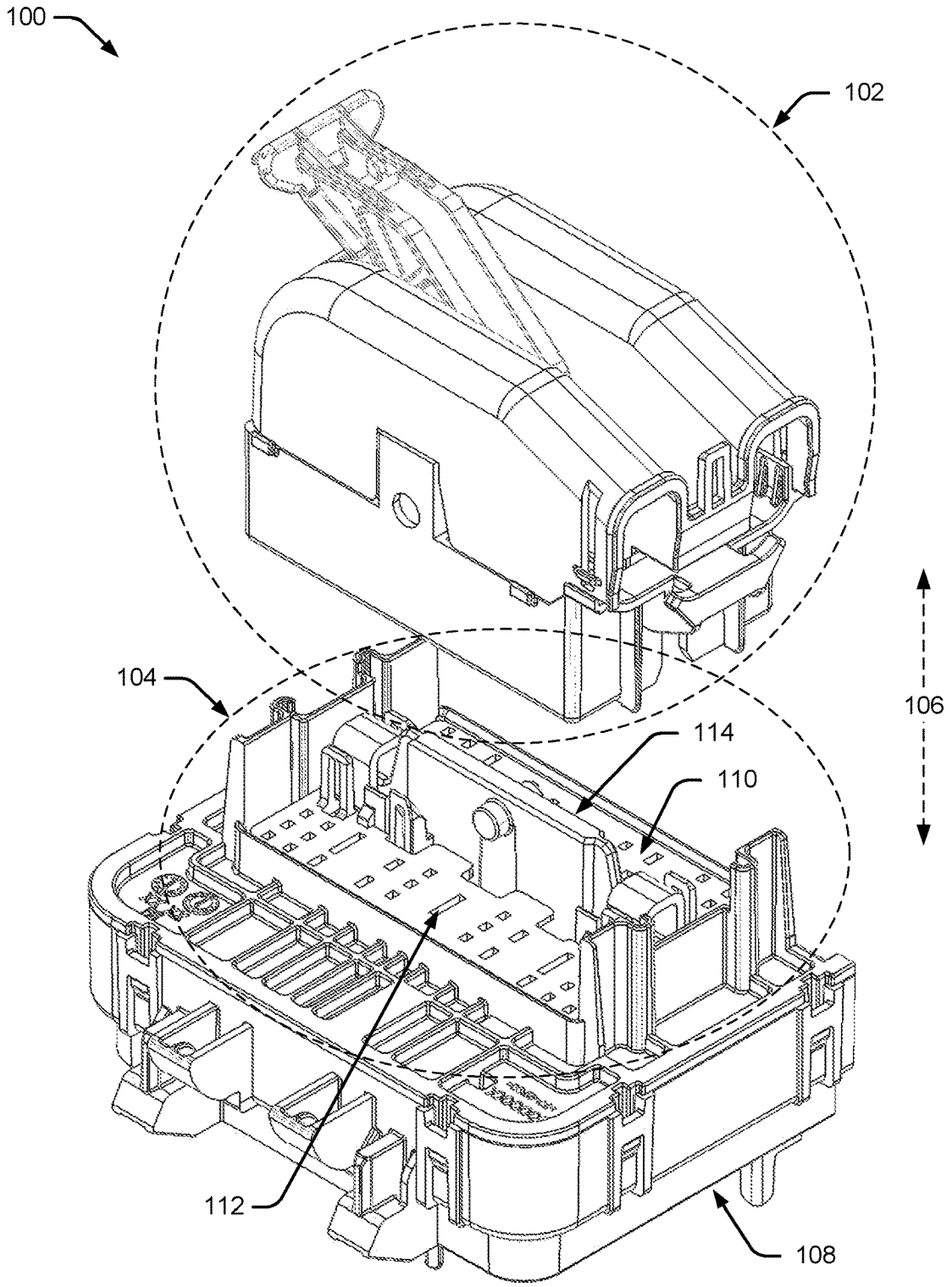
FIG. 1 illustrates an example lever-type electrical connector assembly.

FIG. 1 illustrates an example lever-type electrical connector assembly 100. The components of the lever-type electrical connector assembly 100 are generally constructed of non-conductive materials, such as plastic, and manufactured by injection molding, additive manufacturing such as three-dimensional printing, blow molding, machining, or any other manufacturing techniques generally applicable to plastic parts. The lever-type electrical connector assembly 100 contains a lever-type electrical connector 102 for engagement with a corresponding mating electrical connector 104 along a mating axis 106. Although the corresponding mating electrical connector 104 is shown as part of an electrical-center 108, the corresponding mating electrical connector 104 may be disposed as part of a harness, a wire, a cable, a (e.g., flat-wire) flexible printed circuit, or any other device to which the lever-type electrical connector 102 may be attached.

The lever-type electrical connector assembly 100 also contains a terminal-position-assurance device 110 that is generally disposed within the corresponding mating electrical connector 104 and configured to maintain alignment of terminals of the corresponding mating electrical connector 104 prior to and throughout engagement with corresponding terminals of the lever-type electrical connector 102. Holes 112 of the terminal-position-assurance device 110 are configured to align with the terminals of the corresponding mating electrical connector 104 when installed (terminals are not shown in FIG. 1). The holes 112 are generally arranged in two groups, each on one side or another of a rib protrusion 114 emerging from the corresponding mating electrical connector 104. The terminal-position-assurance device 110 is disposed over a portion of the rib protrusion 114 (described further below in relation to FIG. 2) and moves along the mating axis 106 as the lever-type electrical connector 102 engages the corresponding mating electrical connector 104.

The corresponding mating electrical connector 104 is described below in relation to FIG. 2, the lever-type electrical connector 102 is described below in relation to FIG. 3, and the engagement of the lever-type electrical connector 102 to the corresponding mating electrical connector 104 is described further below in relation to FIG. 5.

Corresponding Mating Electrical Connector

Figure 2:
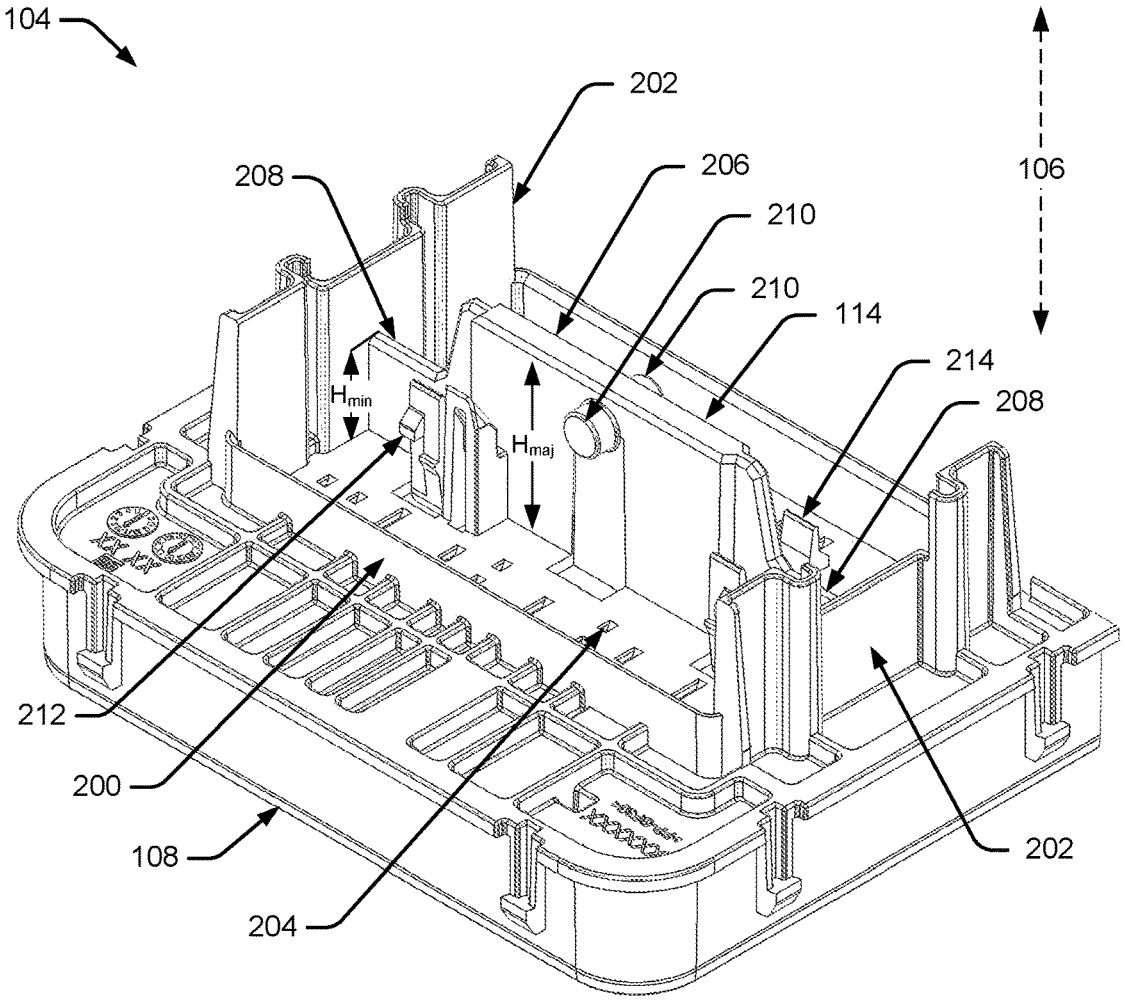
FIG. 2 illustrates an example corresponding mating electrical connector for accepting a lever-type electrical connector.

FIG. 2 is an illustration of the example corresponding mating electrical connector 104, shown in greater detail than in FIG. 1. The corresponding mating electrical connector 104 is disposed on a portion of the electrical-center 108. The corresponding mating electrical connector 104 is defined by side wall protrusions 200 and end wall protrusions 202. The side wall protrusions 200 and end wall protrusions 202 maintain a position of the lever-type electrical connector 102 when inserted on the corresponding mating electrical connector 104. The side wall protrusions 200 and end wall protrusions 202 may be any height and/or configuration without departing from the scope of this disclosure. As shown, one of the end wall protrusions 202 is shorter than the other to allow room for wires of a harness attached to the lever-type electrical connector 102.

The corresponding mating electrical connector 104 contains a rib protrusion 114 connected to end wall protrusions 202. Although shown centered in the corresponding mating electrical connector 104, the rib protrusion 114 may be disposed off-center to allow for uneven loading by terminals protruding through cavities 204. As shown, the rib protrusion 114 has a major height portion 206 defined by a major height ($H_{maj}$) located generally central on the rib protrusion 114, and two minor height portions 208 each defined by a minor height ($H_{min}$). Each of the two minor height portions 208 between the major height portion 206 and either of the end wall protrusions 202. The rib protrusion 114 contains cam-follower protrusions 210 extending from outward-facing sides of the first portion 106 of the rib protrusion 114 for engaging with cam grooves on the lever-type electrical connector 102. The two minor height portions 208 allow for the terminal-position-assurance device 110 to locate on the corresponding mating electrical connector 104 while not causing the terminal-position-assurance device 110 to interfere with engagement of the lever-type electrical connector 102.

The corresponding mating electrical connector 104 also contains containment extensions 212 disposed on each side of the rib protrusion 114 for keeping the terminal-position-assurance device 110 maintained in a pre-stage position prior to engagement with the lever-type electrical connector 102. Without the containment extensions 212, terminal-position-assurance device 110 would be free to "fall out" of the corresponding mating electrical connector 104. Locators 214 disposed on each side of the rib protrusion 114 allow for alignment of the lever-type electrical connector 102 when being connected to the corresponding mating electrical connector 104.

Lever-Type Electrical Connector

Figure 3:
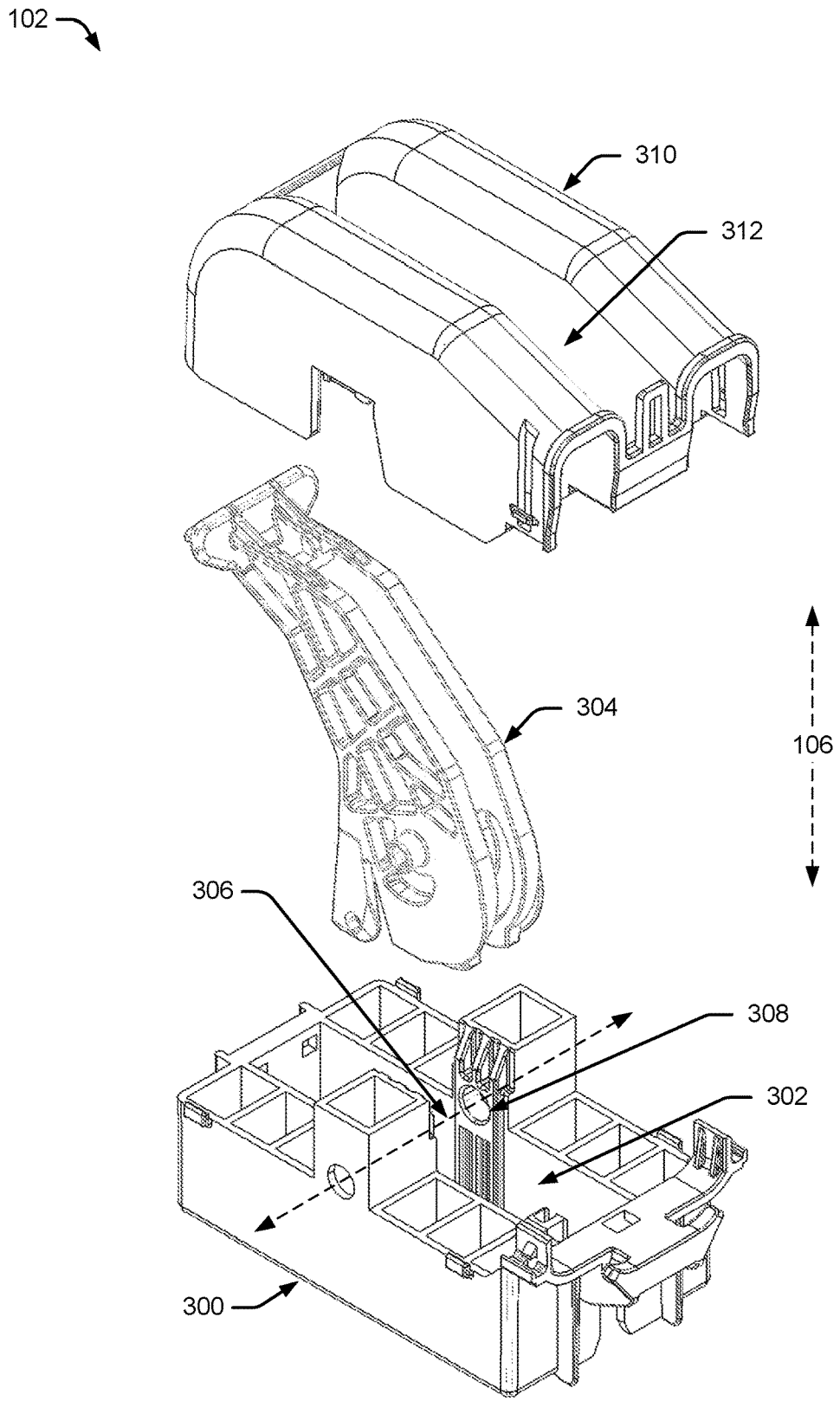
FIG. 3 illustrates an example lever-type electrical connector.

FIG. 3 is an illustration of the example lever-type electrical connector 102 shown in greater detail than in FIG. 1. The lever-type electrical connector 102 contains a first portion 300 that engages with the corresponding mating electrical connector 104. The first portion 300 has a first slot 302 formed therethrough to enable a lever 304 to rotate on a rotation axis 306 perpendicular to the mating axis 106. The lever 304 is mounted via bosses of the lever 304 that are disposed in rotation recesses 308 on either side of the first slot to enable the rotation about the rotation axis 306. The lever-type electrical connector 102 also contains a second portion 310 with a second slot 312 centered on the first slot 302 of the first portion 300. The second slot 312 allows for the rotation of the lever 304. Although shown as a two-piece structure, the lever-type electrical connector may comprise a single piece or more than two pieces.

Lever

Figure 4:
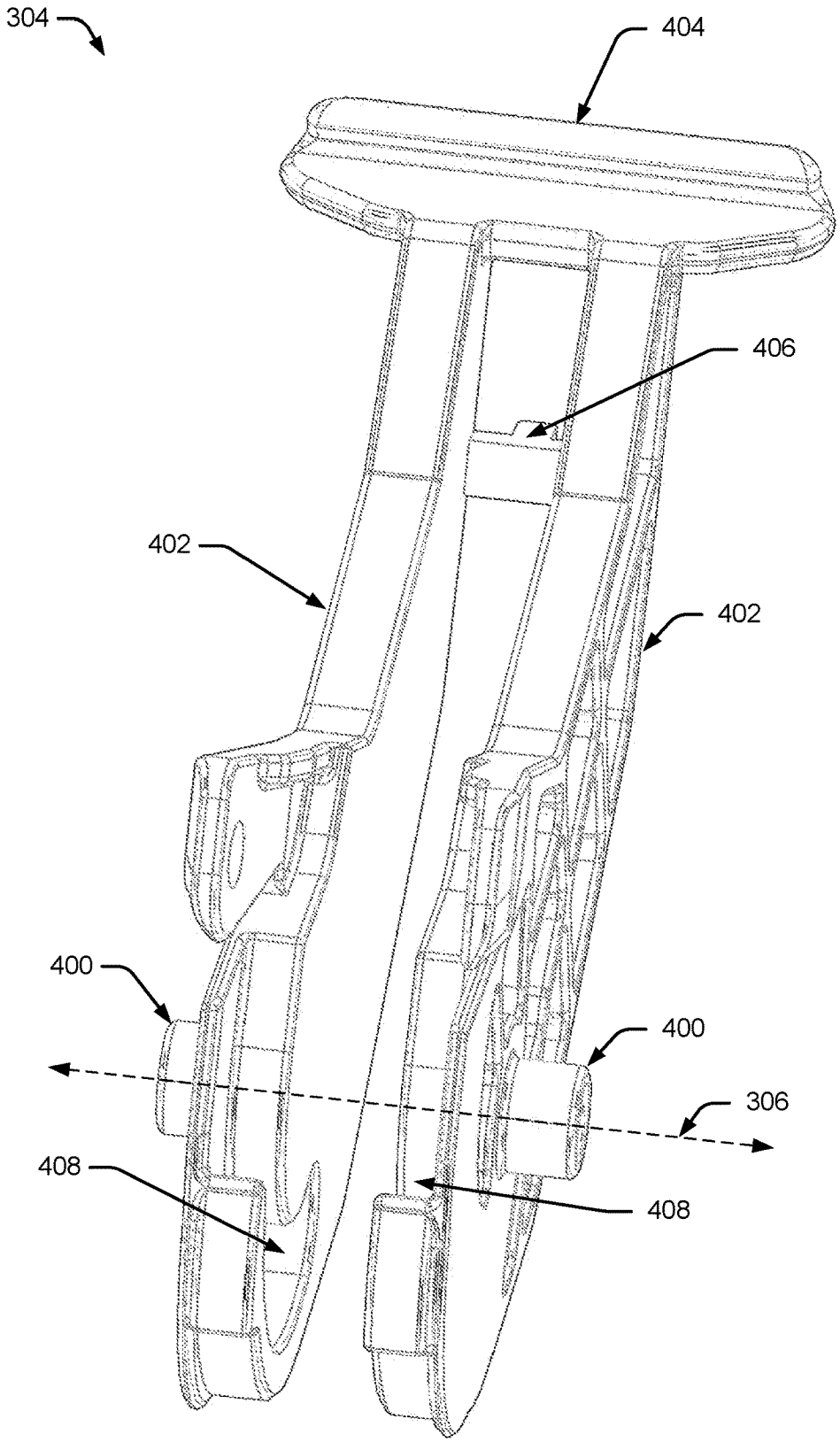
FIG. 4 illustrates an example lever for implementation in a lever-type electrical connector.

FIG. 4 is an illustration of the example lever 304 for use in lever-type electrical connector 102, shown in more detail than FIG. 3. The lever 304 is configured to rotate about rotation axis 306 via mounting protrusions 400, when the mounting protrusions 400 are disposed in rotation recesses 308. The lever 304 contains two generally parallel planar portions 402 configured to straddle the rib protrusion 114 when the lever-type electrical connector 102 is connected to the corresponding mating electrical connector 104. The planar portions 402 are connected via a handle 404 for opening and closing the lever, and a connection portion 406 for further strength and support. The connection portion 406 may be removed based on a size of the handle 404, or a plurality of connection portions 406 may be used. The planar portions 402 contain cam grooves 408 disposed on inner surfaces of the planar portions 402 for engaging the cam-follower protrusions 210. The inner surface cam grooves 408 enable the lever to straddle the rib protrusion 114 and engage the cam-follower protrusions 210. By straddling the rib protrusion 114, resultant forces incurred by the cam grooves 408 on the cam-follower protrusions 210 create a compressive force on the rib protrusion 114, which can mitigate the compressive force without additional support. Although shown as a single piece, the lever 304 may be configured as two separate pieces connected by either the handle 404 and/or connection portion 406. The connection may be an adhesive connection, sonic weld, thermal weld, snap fit, fastened, etc.

Connected Lever-Type Electrical Connector Assembly

Figure 5:
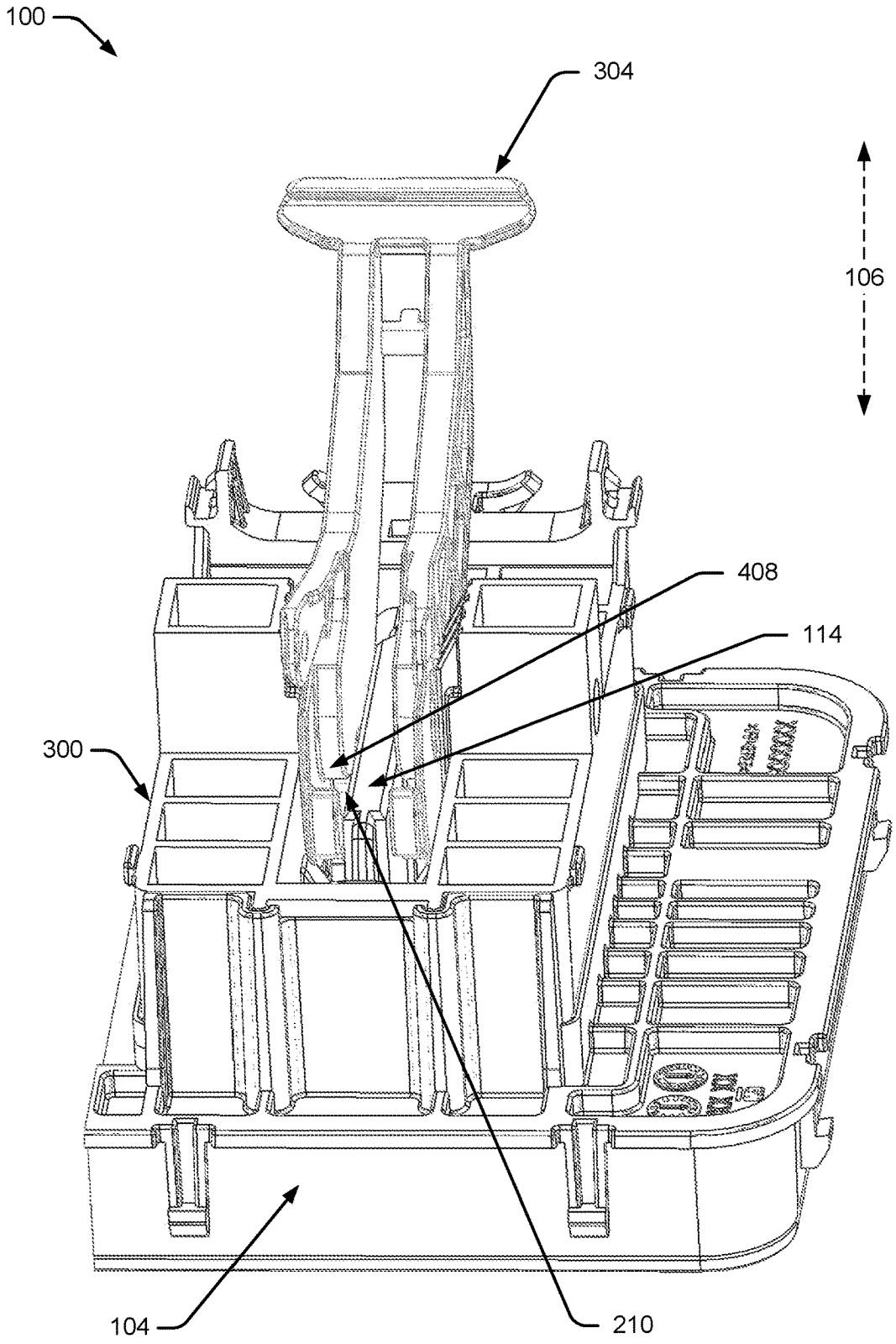
FIG. 5 illustrates a portion of the lever-type electrical connector assembly of FIG. 1 in a connected state.

FIG. 5 is an illustration of the lever-type electrical connector assembly 100 in a connected state, e.g., terminals disposed in the lever-type electrical connector 102 are connected with corresponding terminals disposed in the corresponding mating electrical connector 104. Only the first portion 300 and the lever 304 of the lever-type electrical connector 102 are shown. The second portion 310 of the lever-type electrical connector 102 is not shown in order to show the engagement with the corresponding mating electrical connector 104. The lever 304 is in a closed position when the lever-type electrical connector assembly 100 is in the connected state and in an open position when the lever-type electrical connector assembly 100 is in a disconnected state, e.g., as shown in FIG. 1.

As shown, the lever 304 is disposed on each side of the rib protrusion 114 with the cam grooves 408 engaging the cam-follower protrusions 210 of the rib protrusion 114. As the lever 304 is rotated from the open position to the closed position, the lever-type electrical connector assembly 100 is reconfigured from a disconnected state, e.g. terminals are not connected, to a connected state, e.g. terminals are connected. As discussed above, by engaging cam-follower protrusions 210 on the rib protrusion 114 instead of cam-follower protrusions on the side wall protrusions 200, as is traditionally done, the forces become compressive on the rib protrusion 114 which does not necessitate further reinforcement. Furthermore, because there is no bending force on the rib protrusion 114, the cam-follower protrusions 210 are unable to slip out of the cam grooves 408.

EXAMPLES

Example 1: A lever-type electrical connector for attachment to a corresponding mating electrical connector, the lever-type electrical connector comprising: a connector body comprising a first portion configured to mate to the corresponding mating electrical connector, the first portion comprising a first slot configured to accept a rib protrusion of the corresponding mating electrical connector; and a lever: disposed within the first slot; pivotally mounted to the first portion; configured to pivot about an axis perpendicular to the first slot; comprising parallel planar portions; and comprising cam grooves on opposing interior surfaces of the parallel planar portions, the cam grooves configured to accept cam-follower protrusions on opposite sides of the rib protrusion of the corresponding mating electrical connector such that the lever-type electrical connector is mated to the corresponding mating electrical connector when the lever is rotated from an open position to a closed position.

Example 2: The lever-type electrical connector of example 1, wherein the lever is pivotally mounted to the first portion via mounting protrusions extending from opposing exterior surfaces of the parallel planar portions.

Example 3: The lever-type electrical connector of example 1, wherein the connector body further comprises a second portion affixed to the first portion, the second portion comprising a second slot centered with the first slot and configured to allow the lever to rotate from the open position to the closed position.

Example 4: The lever-type electrical connector of example 1, wherein the parallel planar portions are mirrored relative to each other.

Example 5: The lever-type electrical connector of example 1, wherein the lever further comprises a connection portion connecting the parallel planar portions.

Example 6: The lever-type electrical connector of example 5, wherein the lever comprises a molded or additively-manufactured piece.

Example 7: The lever-type electrical connector of example 5, wherein: the lever comprises at least two pieces; and the connection portion comprises a snap fit of the at least two pieces.

Example 8: A corresponding mating electrical connector for accepting a lever-type electrical connector, the corresponding mating electrical connector comprising: a plurality of cavities for accepting corresponding electrical terminals; and a rib protrusion: bisecting the plurality of cavities into two sides; protruding along a mating axis from the corresponding mating electrical connector; and comprising cam-follower protrusions extending from outward-facing sides of the rib protrusion and configured to accept corresponding cam grooves in a lever of the lever-type electrical connector.

Example 9: The corresponding mating electrical connector of example 8, wherein the corresponding mating electrical connector is disposed as part of an electrical-center.

Example 10: The corresponding mating electrical connector of example 8, wherein the rib protrusion is centered within the corresponding mating electrical connector between the two sides.

Example 11: The corresponding mating electrical connector of example 8, wherein the rib protrusion is not centered within the corresponding mating electrical connector between the two sides.

Example 12: The corresponding mating electrical connector of example 8, wherein the cam-follower protrusions comprise cylinders extending from the outward-facing sides of the rib protrusion.

Example 13: The corresponding mating electrical connector of example 8, further comprising end wall protrusions: protruding from the corresponding mating electrical connector along the mating axis of the corresponding mating electrical connector; oriented perpendicular to the rib protrusion; and positioned on two respective sides of the plurality of cavities.

Example 14: The corresponding mating electrical connector of example 13, wherein a portion of the rib protrusion defined by a major height does not extend to the end wall protrusions.

Example 15: The corresponding mating electrical connector of example 14, wherein portions of the rib protrusion defined by a minor height extend from the portion of the rib protrusion defined by the major height to the end wall protrusions.

Example 16: The corresponding mating electrical connector of example 15, wherein the portions defined by the minor height are configured to align a terminal-position-assurance device.

Example 17: A lever-type electrical connector assembly comprising: a corresponding mating electrical connector comprising: a plurality of cavities for accepting corresponding electrical terminals, the plurality of cavities separated into two sides; and a rib protrusion intermediate the two sides; protruding parallel to a mating axis of the corresponding mating electrical connector; and comprising cam-follower protrusions extending from outward-facing sides of the rib protrusion; a terminal-position-assurance device disposed in the corresponding mating electrical connector: configured to accept the electrical terminals; having a connection portion bridging the two sides over a portion of the rib protrusion; and configured to move parallel to the mating axis of the corresponding mating electrical connector; and a lever-type electrical connector comprising: a connector body comprising a first portion mated to the corresponding mating electrical connector, the first portion comprising a first slot surrounding the rib protrusion of the corresponding mating electrical connector; and a lever: disposed within the first slot of the first portion of the lever-type electrical connector; pivotally mounted to the first portion; configured to pivot about an axis perpendicular to the first slot; effective to move the lever from an open position where the first portion of the lever-type electrical connector is not mated to the corresponding mating electrical connector to a closed position where the first portion of the lever-type electrical connector is mated to the corresponding mating electrical connector; comprising parallel planar portions; and comprising cam grooves on opposing interior surfaces of the parallel planar portions, the cam grooves engaging the cam-follower protrusions on the rib protrusion of the corresponding mating electrical connector.

Example 18: The lever-type electrical connector assembly of example 17, wherein the lever is pivotally mounted to the first portion of the lever-type electrical connector via mounting protrusions extending from opposing exterior surfaces of the parallel planar portions.

Example 19: The lever-type electrical connector assembly of example 17, wherein the corresponding mating electrical connector further comprises end wall protrusions: protruding parallel to the mating axis of the corresponding mating electrical connector; oriented perpendicular to the rib protrusion; and positioned on two respective sides of the plurality of cavities.

Example 20: The lever-type electrical connector assembly of example 19, a major height portion of the rib protrusion that is central to the rib protrusion does not extend to the end wall protrusions; minor height portions of the rib protrusion extend between the major height portion and the end wall protrusions; and the terminal-position-assurance device connects the two sides over the minor height portions.

Conclusion

Although a lever-type electrical connector assembly and portions thereof have been described in language specific to features and/or methods, it is to be understood that the subject of the appended claims is not necessarily limited to the specific features or methods described. Rather, the specific features and methods are disclosed as example implementations of a lever-type electrical connector assembly.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

What is claimed is:

1. A lever-type electrical connector for attachment to a corresponding mating electrical connector, the lever-type electrical connector comprising:

a connector body comprising a first portion configured to mate to the corresponding mating electrical connector, the first portion comprising a first slot configured to accept a rib protrusion of the corresponding mating electrical connector; and a lever:

disposed within the first slot;

pivotally mounted to the first portion;

configured to pivot about an axis perpendicular to the first slot;

comprising parallel planar portions; and comprising cam grooves on opposing interior surfaces of the parallel planar portions, the cam grooves configured to accept cam-follower protrusions on opposite sides of the rib protrusion of the corresponding mating electrical connector such that the lever-type electrical connector is mated to the corresponding mating electrical connector when the lever is rotated from an open position to a closed position.

2. The lever-type electrical connector of claim 1, wherein the lever is pivotally mounted to the first portion via mounting protrusions extending from opposing exterior surfaces of the parallel planar portions.

3. The lever-type electrical connector of claim 1, wherein the connector body further comprises a second portion affixed to the first portion, the second portion comprising a second slot centered with the first slot and configured to allow the lever to rotate from the open position to the closed position.

4. The lever-type electrical connector of claim 1, wherein the parallel planar portions are mirrored relative to each other.

5. The lever-type electrical connector of claim 1, wherein the lever further comprises a connection portion connecting the parallel planar portions.

6. The lever-type electrical connector of claim 5, wherein the lever comprises a molded or additively-manufactured piece.

7. The lever-type electrical connector of claim 5, wherein:

the lever comprises at least two pieces; and the connection portion comprises a snap fit of the at least two pieces.

8. A corresponding mating electrical connector for accepting a lever-type electrical connector, the corresponding mating electrical connector comprising:

a plurality of cavities for accepting corresponding electrical terminals; and a rib protrusion:

bisecting the plurality of cavities into two sides;

protruding along a mating axis from the corresponding mating electrical connector; and comprising cam-follower protrusions extending from outward-facing sides of the rib protrusion and configured to accept corresponding cam grooves in a lever of the lever-type electrical connector.

9. The corresponding mating electrical connector of claim 8, wherein the corresponding mating electrical connector is disposed as part of an electrical-center.

10. The corresponding mating electrical connector of claim 8, wherein the rib protrusion is centered within the corresponding mating electrical connector between the two sides.

11. The corresponding mating electrical connector of claim 8, wherein the rib protrusion is not centered within the corresponding mating electrical connector between the two sides.

12. The corresponding mating electrical connector of claim 8, wherein the cam-follower protrusions comprise cylinders extending from the outward-facing sides of the rib protrusion.

13. The corresponding mating electrical connector of claim 8, further comprising end wall protrusions:

protruding from the corresponding mating electrical connector along the mating axis of the corresponding mating electrical connector;

oriented perpendicular to the rib protrusion; and positioned on two respective sides of the plurality of cavities.

14. The corresponding mating electrical connector of claim 13, wherein a portion of the rib protrusion defined by a major height does not extend to the end wall protrusions.

15. The corresponding mating electrical connector of claim 14, wherein portions of the rib protrusion defined by a minor height extend from the portion of the rib protrusion defined by the major height to the end wall protrusions.

16. The corresponding mating electrical connector of claim 15, wherein the portions defined by the minor height are configured to align a terminal-position-assurance device.

17. A lever-type electrical connector assembly comprising:

a corresponding mating electrical connector comprising:

a plurality of cavities for accepting corresponding electrical terminals, the plurality of cavities separated into two sides; and a rib protrusion:

intermediate the two sides;

protruding parallel to a mating axis of the corresponding mating electrical connector; and comprising cam-follower protrusions extending from outward-facing sides of the rib protrusion;

a terminal-position-assurance device disposed in the corresponding mating electrical connector:

configured to accept the electrical terminals;

having a connection portion bridging the two sides over a portion of the rib protrusion; and configured to move parallel to the mating axis of the corresponding mating electrical connector; and a lever-type electrical connector comprising:

a connector body comprising a first portion mated to the corresponding mating electrical connector, the first portion comprising a first slot surrounding the rib protrusion of the corresponding mating electrical connector; and a lever:

disposed within the first slot;

pivotally mounted to the first portion;

configured to pivot about an axis perpendicular to the first slot, effective to move the lever from an open position where the first portion of the lever-type electrical connector is not mated to the corresponding mating electrical connector to a closed position where the first portion of the lever-type electrical connector is mated to the corresponding mating electrical connector;

comprising parallel planar portions; and comprising cam grooves on opposing interior surfaces of the parallel planar portions, the cam grooves engaging the cam-follower protrusions on the rib protrusion of the corresponding mating electrical connector.

18. The lever-type electrical connector assembly of claim 17, wherein the lever is pivotally mounted to the first portion of the lever-type electrical connector via mounting protrusions extending from opposing exterior surfaces of the parallel planar portions.

19. The lever-type electrical connector assembly of claim 17, wherein the corresponding mating electrical connector further comprises end wall protrusions:

protruding parallel to the mating axis of the corresponding mating electrical connector;

oriented perpendicular to the rib protrusion; and positioned on two respective sides of the plurality of cavities.

20. The lever-type electrical connector assembly of claim 19, wherein:

a major height portion of the rib protrusion that is central to the rib protrusion does not extend to the end wall protrusions;

minor height portions of the rib protrusion extend between the major height portion and the end wall protrusions; and the terminal-position-assurance device connects the two sides over the minor height portions.

* * * * *